United States Patent [19]

Campbell

[11] 4,211,091

[45] Jul. 8, 1980

[54] INSULATED LUNCH BAG

[76] Inventor: June H. Campbell, P.O. Box 4162, Foster City, Calif. 94404

[21] Appl. No.: 14,488

[22] Filed: Feb. 23, 1979

[51] Int. Cl.[2] ..... F25D 3/08

[52] U.S. Cl. ..... 62/372; 150/2.1; 150/3; 150/34

[58] Field of Search ..... 62/372, 457; 150/2.1, 150/2.2, 2.5, 12, 3

[56] References Cited

U.S. PATENT DOCUMENTS

| | | | |
|---|---|---|---|
| 2,216,330 | 10/1940 | Stover | 62/372 |
| 2,289,254 | 7/1942 | Eagles | 150/2.1 UX |
| 2,555,126 | 5/1951 | Greve | 62/457 X |
| 2,667,198 | 1/1954 | Klein | 150/2.1 |
| 2,825,208 | 3/1958 | Anderson | 150/34 X |
| 3,143,748 | 8/1964 | Manning | 150/12 X |
| 3,414,033 | 12/1968 | Tucker | 150/34 |
| 3,632,029 | 1/1972 | Sonner | 150/3 |

FOREIGN PATENT DOCUMENTS

| | | | |
|---|---|---|---|
| 449656 | 7/1936 | United Kingdom | 62/372 |

*Primary Examiner*—Donald F. Norton
*Attorney, Agent, or Firm*—T. R. Zegree

[57] ABSTRACT

A flexible insulated lunch bag adapted for transportation and storage of food comprises a liner disposed in the interior thereof, means for opening and closing the bag attached near its top and a carrying means affixed to the upper portion of the bag. When empty, the bag can be folded or rolled up to a fraction of its overall length.

7 Claims, 7 Drawing Figures

INSULATED LUNCH BAG

BACKGROUND OF THE INVENTION

The present invention is a continuation-in-part application of my application Ser. No. 750,171, filed Dec. 13, 1976 and now abandoned.

This invention relates generally to portable containers for food and more particularly to an insulated, pliable lunch bag adapted for carrying food and drinks while protecting them from deterioration.

Portable containers for carrying food have been known for many years. The most popular containers still widely in use today are lunch boxes. Containers of this type, while somewhat satisfactory in some instances, are characterized by a disadvantage in that their body is of a rigid metallic or plastic construction and in that the food items placed therein are frequently susceptible to deterioration or soft drinks become undesirably warm in a relatively short period of time, especially in hot weather. Other types of food containers in form of bags or the like receptacles constructed from fabric or plastic materials which constitute the closest prior art of which I am aware have been described in U.S. Pat. Nos. 2,289,254 to Eagles and 2,667,198 to Klein. However, such bags have the common disadvantage of lacking pliability necessary for being folded or rolled up when empty. Consequently their overall size remains substantially the same after the food items have been removed which renders such bags somewhat cumbersome and inconvenient as they require to be hand-carried in empty condition. Moreover, the constitutional features of such bags are distinct from those of the lunch bag of this invention.

OBJECTS OF THE INVENTION

An important object of this invention is to provide an improved lightweight, flexible, insulated lunch bag, the overall size of which may be reduced to about a half or more when empty.

Another object of the invention is to provide an insulated bag for transportation and temporary storage of food without spoilage thereof when the bag contains an ice pack and is closed to keep the food items cool.

Still another object of the invention is to provide a pliable lunch bag which may easily be manufactured at a low cost from readily available materials.

These and other objects of the invention will become more fully apparent as the description proceeds in the following specification and the accompanying drawings.

BRIEF SUMMARY OF THE INVENTION

In accordance with the present invention, there is provided a foldable, flexible, insulated lunch bag comprising a top, a front wall, a rear wall, a bottom wall and a pair of side walls. Each wall comprises an outer wall and an inner wall with a layer of an insulating material being disposed therebetween. The inner walls include a liner which is disposed in the interior of the bag. The bag further comprises a means for opening and closing thereof and a carrying means affixed to the upper portion of the bag. After the food contents have been removed, the bag may be folded on itself or rolled up in such a manner that its overall length is reduced to about a half or more.

BRIEF DESCRIPTION OF THE DRAWINGS

In the accompanying drawings.

Like reference characters indicate corresponding elements throughout the views of the drawings.

DETAILED DESCRIPTION

Figure 1:
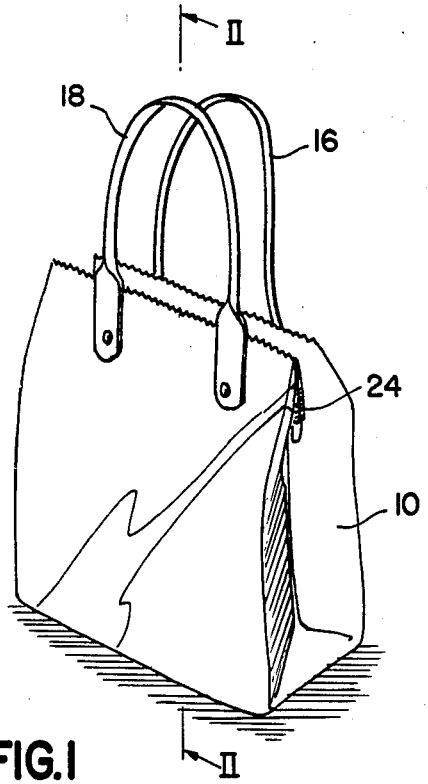
FIG. 1 is a perspective view of one form of the lunch bag.
Figure 2:
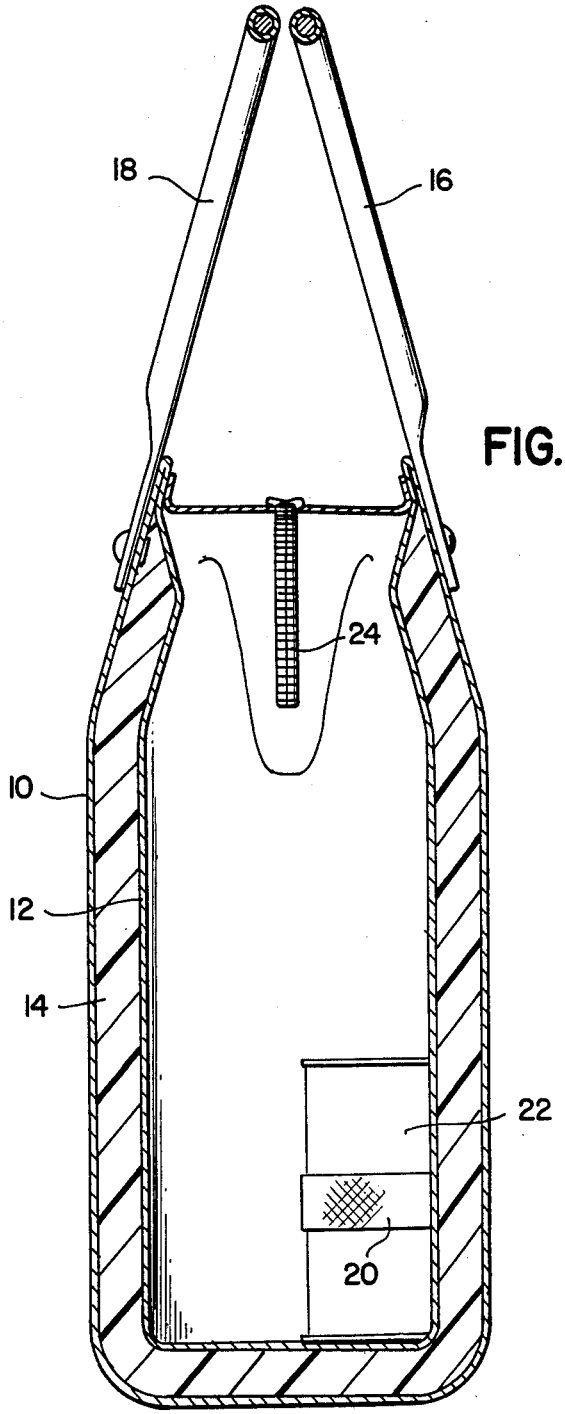
FIG. 2 is a cross-sectional view of the lunch bag taken in the plane 2—2 of FIG. 1.
Figure 3:
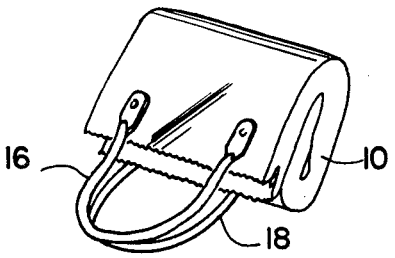
FIG. 3 is a perspective view of the lunch bag of FIG. 1 folded when empty.

As illustrated in FIGS. 1 to 3, a foldable, flexible, insulated double-walled lunch bag 10 with an inner liner 12 is filled with an insulating material 14 disposed between the outer walls of the bag 10 and the liner 12 to protect the food contents placed in the bag from exchange with the conditions of external environment. The insulating material 14 suitable for use in making the bag of this invention may be formed of a lightweight polymeric material, such as polystyrene or polyurethane foam.

While the liner 12 may be constituted by the inner wall itself of bag 10, it may also be secured either adhesively or by stitching or by any other suitable method to all the inner side walls and the bottom wall of the lunch bag, thereby forming a unitary composite inner wall of bag 10. The outer walls of bag 10 are formed of a suitable cloth or plastic material, while liner 12 is made of a waterproof material, such as a flexible plastic film or a rubber-treated fabric, and comprises a strap 20 which is attached to the lower inner surface of bag 10 for removable insertion of a frozen ice pack 22 between strap 20 and the inner surface of liner 12 to keep the food contents in the bag cool.

The lunch bag 10 is provided with carrying means in form of a pair of handles 16 and 18 attached to the upper portion thereof to permit convenient carrying of the bag. The means for opening and closing bag 10 is a conventional zipper 24 disposed across the top of the bag for removable placing of food items and of the ice pack 22 therein. When bag 10 is closed by means of zipper 24, a substantially air-tight seal is formed, whereby a refrigerating temperature may be maintained inside the bag in the presence of the inserted ice pack 22. If desired, hot food items may also be transported in the insulated bag 10 without the use of frozen ice pack therein.

In another embodiment of the present invention, as illustrated in FIGS. 4 to 7, the lunch bag 10' comprises a few modifications, the description of which follows.

In accordance with this embodiment, the lunch bag 10' is of the open-top type construction and comprises a front wall 26, a rear wall 28, a bottom wall 30 and a pair of side walls 32. Each of these walls comprises an outer wall 34 and an inner wall 36, all the walls being made of a suitable flexible fabric or plastic material, the outer walls of bag 10' being preferably waterproof or water repellent.

Figure 5:
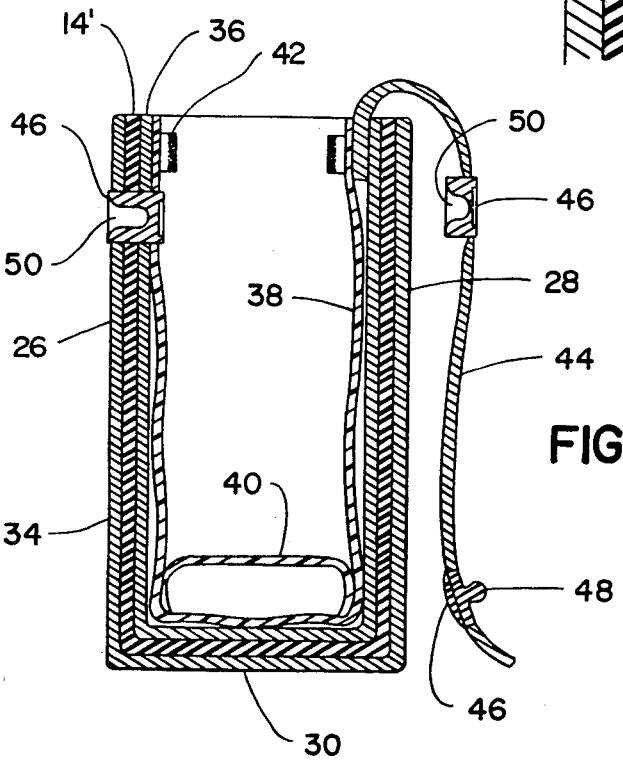
FIG. 5 is a cross-sectional view of the lunch bag of FIG. 4 in open top position with one end of the carrying means being unattached to the front wall.

A layer of a suitable insulating material 14' formed of a lightweight polymeric material, examples of which are given hereinabove, is disposed substantially evenly between outer walls 34 and inner walls 36 filling the space therebetween. A waterproof liner 38 made preferably of a flexible plastic film, such as vinyl, or a rubberized lightweight cloth or the like, in form of a sac, is disposed in the interior of bag 10' with the narrow upper portion thereof being attached by stitching adjacent the top of bag 10', the unattached major portion of liner 38 being disposed adjacent the inner walls of the bag. The liner 38 may be provided with a pocket 40 extending substantially horizontally near the bottom of bag 10', as best shown in FIG. 5, for removable insertion of a frozen ice pack therein.

Figure 4:
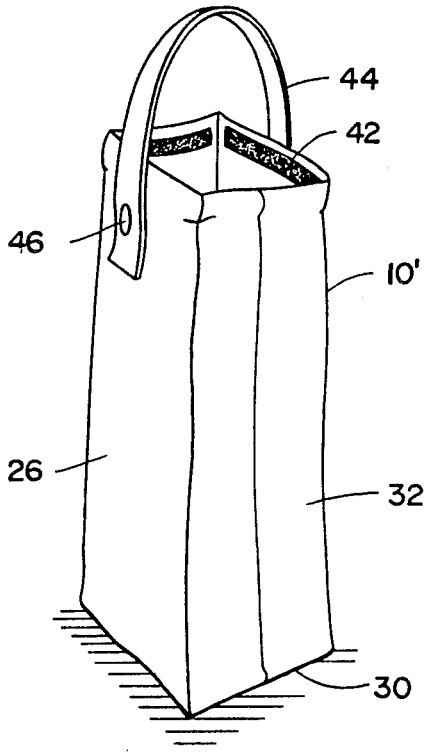
FIG. 4 is a perspective view of another form of the lunch bag in open top position with the carrying means fastened to the front and rear walls.

The lunch bag 10' is further provided with a means for opening and closing its top. Such means comprises a pliable adhesive tape fastener 42 which is secured by stitching or adhesively to bag 10' around the upper periphery thereof, as shown in FIG. 4. The exposed surface of tape fastener 42 is separably adherent to its own surface disposed on the opposite side of bag 10' thereby closing the bag when the opposite adhesive surface of tape fastener 42 are in engaging air-tight contact with each other. One type of a tape fastener which has been found satisfactory is an adhesive tape sold commercially under the trademark "Velcro" and described in U.S. Pat. No. 3,414,033 to Tucker. Other similar adhesive tapes capable of forming a strong but detachable bond therebetween are likewise satisfactory.

Figure 7:
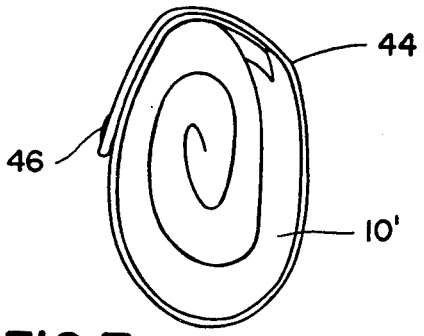
FIG. 7 is a side view of the empty lunch bag of FIG. 4 in rolled up position.
Figure 6:
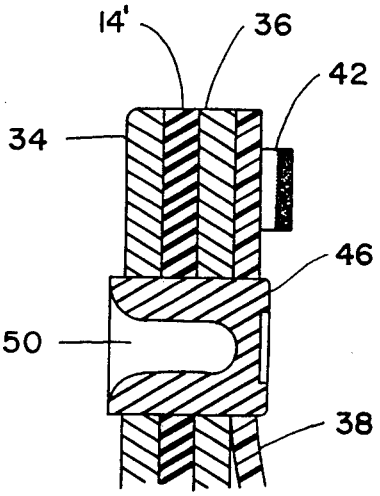
FIG. 6 is a fragmentary enlarged cross-sectional view of the upper portion of the front wall of FIG. 5 showing the various elements thereof in detail.

As a carrying means, the lunch bag 10' comprises a flexible carrying strap 44 which may be formed, if desired, of the same material as the outer wall 34. The strap 44 is affixed by stitching or sewing one end thereof to the upper portion of the rear wall 28 of bag 10', the other free end of strap 44 being detachably fastened to the upper portion of front wall 26 by conventional cooperating snaps 46 or the like fasteners. The carrying strap 44 is preferably attached substantially in the center of rear wall 28 and front wall 26 in the upper portions thereof. As illustrated in FIG. 5, a male element 48 of snap 46 which is affixed near the end portion of strap 44 is separably engageable with the cooperating female element 50 of snap 46, thereby forming a carrying handle when the two elements are joined together. The second female element 50 is secured to strap 44 adjacent the other end thereof for the purpose of engaging it with male element 48 of snap 46 when the empty bag 10' is rolled up or folded on itself, whereby the overall length of bag 10' is reduced to less than a half and frequently to about a third thereof depending on the pliability of the material used for making the walls. As shown in FIG. 7, strap 44 surrounds the bag 10' and is fastened thereto around it.

From the foregoing, it will be understood that this invention provides a highly satisfactory bag for carrying lunch or the like food items by school children, students, teachers, secretaries and other working people who wish to consume their home-prepared food in school or other places of work. The main feature of the present invention is the provision of a durable, lightweight lunch bag, the pliability of which, when empty, permits a reduction of its size to but a fraction of its length thus making it most convenient to place it in the rolled up or folded form in a purse, or a satchel or the like thereby obviating the necessity of carrying an additional object. Another important feature of this invention is that food may be stored in the lunch bag for several hours without being deteriorated, particularly in hot weather due to refrigerating effect imparted by the frozen ice pack inserted therein.

Various changes in the forms of this invention herein described and illustrated may be made without departing from the spirit of the invention and the scope of the claims which follow.

I claim:

1. A durable, flexible insulated lunch bag comprising a top, a front wall, a rear wall, a bottom wall, a pair of side walls, each of said walls comprising an outer wall and an inner wall, a layer of an insulating material disposed substantially evenly between the outer and inner walls, said inner walls including a liner disposed in the interior of said bag, means for opening and closing the bag adjacent the top thereof, and a carrying means affixed to the upper portion of said bag, wherein said bag is of the open top type construction and said means for opening and closing the bag comprises a pliable adhesive tape fastener secured to said bag around the periphery thereof to at least one side and rear wall and being detachably adherent to the fastener disposed on the opposite wall of said bag, and wherein the overall length of said bag is reducible to about one third when the empty bag is folded on itself.

2. The lunch bag of claim 1, wherein said liner is waterproof and flexible and wherein the narrow upper portion of said liner is attached to said bag adjacent the top thereof, the unattached major portion of said liner being disposed adjacent said inner walls of said bag.

3. The lunch bag of claim 2, wherein said liner includes a pocket, a frozen ice pack removably inserted in said pocket and wherein said pocket extends substantially horizontally adjacent the bottom of said bag.

4. The lunch bag of claim 1, wherein said carrying means comprises a flexible carrying strap, one end thereof being attached to the upper portion of said rear wall, the other end thereof being detachably fastened to the upper portion of said front wall.

5. The lunch bag of claim 4, wherein each end of said carrying strap is disposed substantially in the center of said front and rear wall.

6. The lunch bag of claim 1, wherein the overall length of said bag is reducible to about one third when said bag is empty and rolled up with said carrying strap being fastened around said bag by a pair of cooperating male and female snap elements.

7. The lunch bag of claim 1, wherein said liner is waterproof and flexible, wherein the narrow upper portion of said liner is attached to said bag adjacent the top thereof, the unattached major portion of said liner being disposed adjacent said inner walls of said bag;

wherein said liner includes a pocket, a frozen ice pack removably inserted in said pocket and extending substantially horizontally adjacent the bottom of said bag;

wherein said carrying means is a flexible carrying strap, one end thereof being attached to the upper portion of said rear wall, the other end thereof being detachably fastened to the upper portion of said front wall, each end of said carrying strap being disposed in the center of said front and rear wall; and wherein the overall length of said bag is reducible to about one third when said bag is empty and rolled up with said carrying strap being fastened around said bag by a pair of cooperating male and female snap elements.

* * * * *

UNITED STATES PATENT AND TRADEMARK OFFICE

CERTIFICATE OF CORRECTION

PATENT NO. : 4,211,091

DATED : July 8, 1980

INVENTOR(S) : June H. Campbell

It is certified that error appears in the above—identified patent and that said Letters Patent is hereby corrected as shown below:

Column 4, line 43, "1" should read --- 4 ---.

Signed and Sealed this

Fourth Day of November 1980

[SEAL]

*Attest:*

SIDNEY A. DIAMOND

*Attesting Officer*

*Commissioner of Patents and Trademarks*